United States Patent [19]

Bovenkerk

[11] 4,109,737

[45] Aug. 29, 1978

[54] ROTARY DRILL BIT

[75] Inventor: Harold P. Bovenkerk, Worthington, Ohio

[73] Assignee: General Electric Company, Worthington, Ohio

[21] Appl. No.: 699,411

[22] Filed: Jun. 24, 1976

[51] Int. Cl.[2] ..... E21B 9/36

[52] U.S. Cl. ..... 175/329; 175/410; 407/51; 407/118; 407/119

[58] Field of Search ..... 175/329, 330, 410; 76/101 A; 51/307, 809 R; 125/30 R, 39; 29/95 R, 95 A, 95 B, 95 C, 95 D; 425/77

[56] References Cited

U.S. PATENT DOCUMENTS

| | | | |
|---|---|---|---|
| 1,506,119 | 8/1924 | Hansen | 175/329 X |
| 2,121,202 | 6/1938 | Kilgore | 175/410 X |
| 2,582,231 | 1/1952 | Catallo | 175/329 X |
| 3,095,053 | 6/1963 | Pistole et al. | 175/329 |
| 3,407,445 | 10/1968 | Strong | 425/77 |
| 3,702,573 | 11/1972 | Nemeth | 76/101 A |
| 3,745,623 | 7/1973 | Wentorf, Jr. | 76/101 A X |
| 4,006,788 | 2/1977 | Garner | 175/330 |
| 4,014,395 | 3/1977 | Pearson | 175/410 |

FOREIGN PATENT DOCUMENTS

| | | | |
|---|---|---|---|
| 262,916 | 7/1968 | Austria | 175/410 |
| 2,428,365 | 1/1975 | Fed. Rep. of Germany | 175/329 |
| 679,193 | 12/1964 | Italy | 175/403 |
| 980,799 | 1/1965 | United Kingdom | 175/329 |

*Primary Examiner*—Ernest R. Purser
*Assistant Examiner*—Richard E. Favreau
*Attorney, Agent, or Firm*—D. A. Dearing; D. J. Voss; F. L. Neuhauser

[57] ABSTRACT

A rotary drill bit for rock drilling comprising a plurality of cutting elements mounted by interference-fit in recesses in the crown of the drill bit. Each cutting element comprises an elongated pin with a thin layer of polycrystalline diamond bonded to the free end of the pin.

56 Claims, 12 Drawing Figures

ROTARY DRILL BIT

BACKGROUND OF THE INVENTION

This invention relates to rotary drill bits and more particularly to rock drill bits with a polycrystalline abrasive as the cutting or abraiding material.

Conventional rotary drill bits for oil and gas well drilling and core drilling have heretofore used cutting elements such as (1) steel teeth, (2) steel teeth laminated with tungsten carbide, (3) a compact insert of sintered tungsten carbide, and (4) natural diamonds all of which are set or molded in a tungsten carbide crown or cone. Due to the relatively short life and/or high cost of these conventional designs, it has recently been proposed to use synthetic diamond compacts as the cutting element in such drills.

To date, attempts to use diamond compacts in these applications have, for the most part, been unsuccessful. In one such attempt diamond compacts are comprised of right circular cylinders with a thin layer of polycrystalline diamond bonded to a cemented carbide substrate. A cutting element is formed by attaching the compact to the drill bit by brazing or soldering the carbide substrate to a cemented carbide pin which is inserted into holes in the drill crown. The diamond layer is generally oriented in a radial sense to the center of rotation of the drill bit and penetrates the rock essentially as a cutting tool in a similar manner to a cutting tool which is used to cut metal on a lathe. (See FIGS. 1 and 2 herein).

Several problems have been encountered with this design and a commercially feasible drill bit has yet to be tested based on this structure.

One problem is that although in this design the cutting elements protrude from the bit body and thereby provide aggressive cutting action and abundant room for swarf removal, the stresses on each cutting element are severe and frequent failures occur by pin shear or compact cracking. The stresses are caused because the structure of most rocks is heterogeneous and thus has layers of varying hardness. These layers cause a large variation in the impact loads to be applied to the cutting elements during drilling. The prior art designs are not strong enough, nor are the compacts shock resistant enough, to withstand such widely varying impact loading.

Another problem occurs during manufacturing of the cutting element. The process of brazing the composite compacts to the pin structure requires temperatures approaching those where the diamond layer is degraded. Hence, many of the compacts are "softened" if great care is not taken in the brazing operation.

Still another problem is that the degradation temperature (600° C) of the compacts are far below the 1200° C to 1400° C temperature which would be required to sinter the compacts in an abrasion resistant drill crown matrix (e.g., of tungsten carbide) in an analogous manner to that used to fabricate drill crowns of natural diamond set in the surface of an abrasion resistant matrix.

OBJECTS OF THE INVENTION

Accordingly, it is an object of this invention to provide an improved drill bit which eliminates or mitigates the problems noted hereinabove.

Another object of this invention is to provide a rock drill bit with a cutting element which is stronger and more impact resistant.

Another object of the invention is to provide a drill bit with cutting elements which are formed in situ with the formation of the diamond compact.

SUMMARY OF THE INVENTION

These and other objects of the invention, which will be appreciated from a consideration of the following detailed description and accompanying claims, are accomplished by providing a drill bit comprising a plurality of cutting elements which are mounted in an interference fit in recesses in the crown of the drill bit. Each cutting element comprises an elongated pin with a thin layer of polycrystalline abrasive bonded to the free end of the pin.

DESCRIPTION OF THE PREFERRED EMBODIMENTS

Before describing the preferred embodiments of this invention, reference will first be made to FIGS. 1A, 1B and 2, which show prior art rotary drill bit and cutting elements used therein.

Figure 1A:
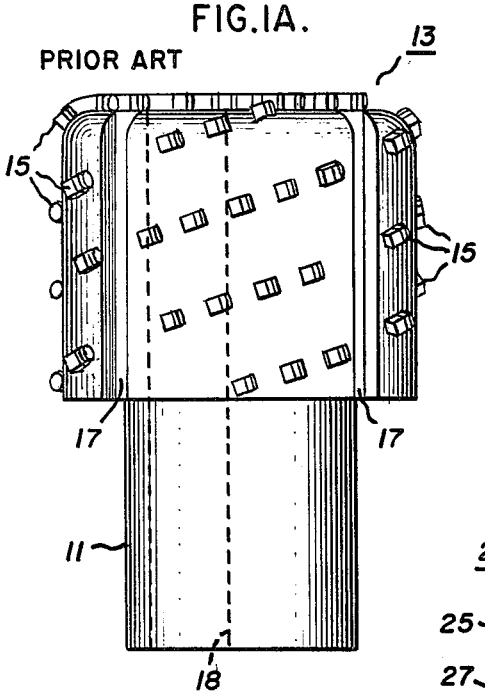
FIG.1A. PRIOR ART
FIG. 1A is an elevational view of a prior art rock drill bit.
Figure 1B:
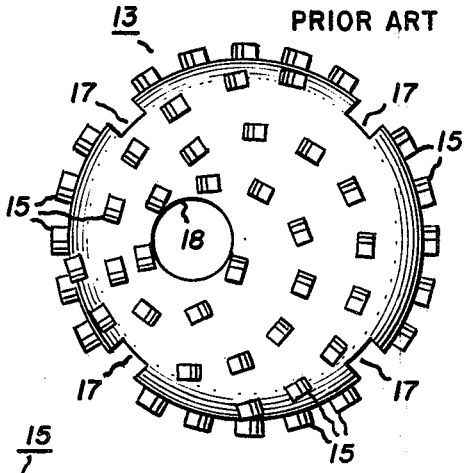
FIG.1B. PRIOR ART
FIG. 1B is a plan view of the drill bit of FIG. 1.

FIGS. 1A and 1B show a rotary drill bit comprising an elongated shaft 11 and a drill crown 13 in which a plurality of cutting elements 15 are mounted in recesses (not shown). A plurality of water ways 17 are formed in the drill crown 13 for providing access of a cooling fluid to the interface between the drill crown and the earth during drilling applications. A fluid part 18 is provided longitudinally of the drill for transmission of fluid to aid in mud and rock cutting removal.

Figure 2:
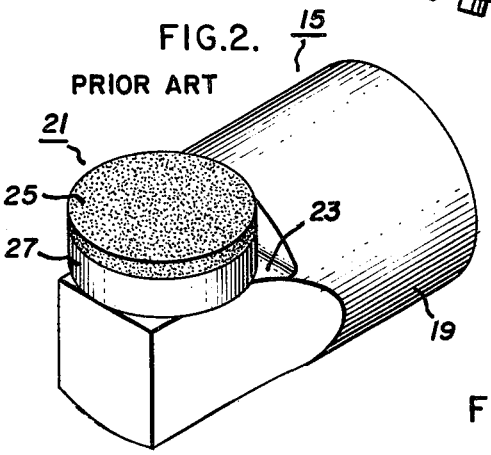
FIG.2. PRIOR ART
FIG. 2 is a perspective view of a prior art cutting element used in the rock drill bit of FIG. 1.

FIG. 2 shows a perspective view of one of the cutting elements 15 shown in FIG. 1. The cutting element 15 comprises an elongated pin 19, preferably of metal bonded carbide (also known as "sintered" or "cemented" carbide) with a composite abrasive 21 mounted at one end in a recess 23 formed in pin 19. The composite abrasive 21 is comprised of a thin layer of polycrystalline diamond 25 bonded to a sintered carbide substrate 27. The composite abrasive element 21 is bonded in the recess 23 usually by brazing or soldering. As discussed hereinabove, this cutting element design has not proved satisfactory because the polycrystalline diamond layer 25 is often degraded by the high temperatures required to form a high strength braze or solder bond between the composite element 21 and the pin 19.

The composite abrasive element 21 can be constructed in accordance with the teaching of Wentorf, Jr. U.S. Pat. No. 3,745,623, patented July 17, 1973 and assigned to the assignee of the invention herein.

Figure 3A:
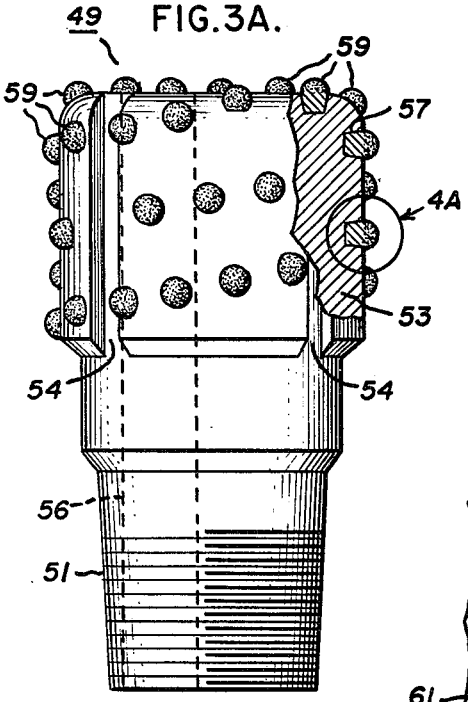
FIG. 3A is an elevational view, partially in cross section, of a rock drill bit in accordance with features of this invention.
Figure 3B:
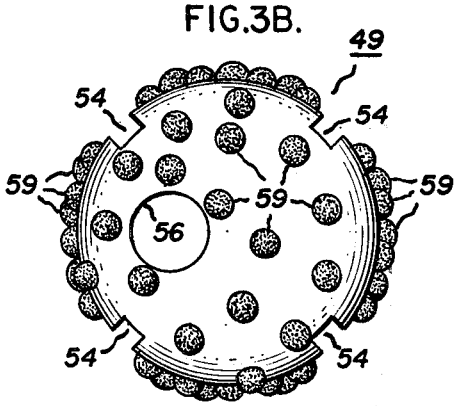
FIG. 3B is a fragmentary cross sectional view of a portion of the drill bit of FIG. 3A.

FIGS. 3A and 3B illustrate a preferred embodiment of a rotary drill bit 49 in accordance with the featues of the invention herein. Bit 49 is comprised of a shaft 51 and a drill crown 53 in which a plurality of cutting elements 59 are mounted in a plurality of recesses 57. Conventionally designed water ways 54 and a fluid port 56 are provided longitudinally of the drill body.

Figure 4A:
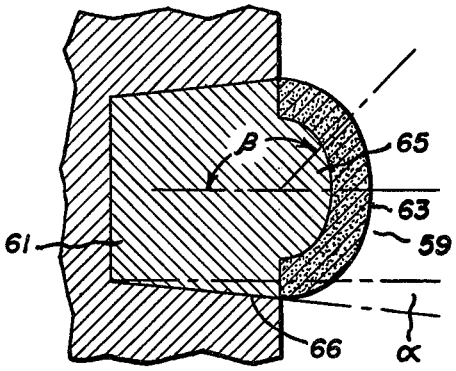
FIG. 4A is a cross-sectional view of one of the cutting elements of the rock drill bit of FIG. 3.

FIG. 4A illustrates, in an enlarged view, one of the cutting elements 59 of the drill bit 49 shown in FIG. 3. Cutting element 59 is comprised of an elongated sintered carbide pin 61 and a thin layer (e.g. between 0.1 to 0.5 cm.) of polycrystalline abrasive 63 bonded to one end 66 of said pin. Pin 61 is formed with a reduced diameter (relative to the diameter of end 66) hemispherical projection 65 over which the diamond layer is directly bonded in the form of a hemispherical cap.

The body of pin 61 is longitudinally tapered at an angle $\alpha$, which is measured between a vertical drawn parallel to the longitudinal axis and a side wall of element 59. Angle $\alpha$ is preferably between 2° and 4°. The taper is chosen such that when mounted in recesses 57 of the drill crown 53, a self-holding or self-locking friction fit is formed. To accomplish this objective, the taper of the pin 61 is about 0.5 to 1% larger at any given diameter along the length of pin 61 relative to the corresponding diameter of the recess 57 so that a tight friction fit is formed when pin 67 is seated in a recess 57. The pin is force fitted into the recess 57 by a hydraulic press or with a suitable support fixture which results in the radial compression of the pin with a stress in the range of approximately 3,500 to 21,000 kg/cm$^2$. The pin, when mounted in this way, will have a tight interference fit in the drill crown such that it can withstand the drilling forces without becoming dislodged from the drill crown recess 57.

Alternatively the pin 61 can be right cylindrically shaped and force fitted into recess 57 using differential thermal expansion techniques.

Another feature of this invention is provided by the hemispherical, cap-shaped, polycrystalline diamond layer 63 formed at the end of pin 61. The design by its nature changes the cutting or abrading action used in the prior art form to a compression spalling action (i.e., the chipping or pulverizing of the rock due to compressional forces). By reference to FIGS. 1A and 1B, it can be seen that the direction of the cutting force which is applied by elements 15 to the rock being drilled would be at an angle (measured from the axis of pin 19) of approximately 90°. This leads to shearing and cracking of the cutting elements 15 when drilling as discussed above. In contrast, the direction of the cutting force applied by cutting element 59 (FIGS. 3A and 3B of the present invention to the rock is at an obtuse angle $\beta$ (measured from the axis of pin 61) of approximately 135° (FIG. 4A). Thus, the compact layer 63 has a more massive support and is more resistant to impact and chippage incurred in drilling applications. The hemispherical shape is also stronger as will be recognized because a shpere is a stronger geometrical shape than the prior art regular polyhedral designs.

Cutting elements, as described in accordance with the features of the invention herein, can be made by the teaching of Wentorf, Jr., U.S. Pat. No. 3,745,623, the disclosure of which is hereby incorporated by reference. The high-pressure, high-temperature apparatus as described in the Wentorf patent is modified for the purposes of this invention to permit the cutting element to be shaped in the manner shown in FIG. 4A in its original shape so that no machining of the diamond layer is needed subsequent to the high-pressure, high-temperature processes. The process is carried out in accordance with the practice of the invention described in Wentorf, Jr., U.S. Pat. No. 3,609,818 which is hereby incorporated by reference.

The body portion of the sintered carbide pin 61 may be shaped subsequent to the formation of the diamond layer thereon in the high-temperature, high-pressure process by diamond grinding to the precision needed for the tapered section. It is preferred that the sintered carbide pin 61 is inserted into the reaction vessel of the high-temperature, high-pressure apparatus as a preformed body. However, as will be recognized by those skilled in the art, such a body need not be preformed and can be formed in situ from carbide molding powder which is preferably a mixture of tungsten carbide powder plus cobalt powder as is disclosed in U.S. Pat. No. 3,745,623, Col. 5, line 58 to Col. 6, line 8.

As further described in U.S. Pat. No. 3,745,623, during the high-pressure, high-temperature process the polycrystalline diamond abrasive which forms the layer 63 is consolidated into a mass of sintered diamond and an excellent bond develops at the interface between the diamond layer 63 and the end of the cemented carbide pin 65 to produce a truly integrated mass at the interface between the diamond layer 63 and the carbide pin 61. Any small spaces between the diamond crystals accommodate intrusions of sintered carbide which is somewhat plastic at the operating temperature of the process. Thus, at the interface the intrusions firmly mechanically interlock the diamond particles with the sintered carbide. The diamond layer 63 is primarily a cluster of diamond crystal bonded together in self-bonded relationship with the diamond particles disposed in random fashion. In order for an incipient fracture to produce cleavage of the diamond mass (or layer) the cleavage plane would have to follow a tortuous course dictated by the random disposition of the cleavage planes of the individual particles. Thus, any fracture which is initiated will be unable to extend very far into the diamond layer.

The direct bonding relationship created in situ between the polycrystalline diamond layer and the larger underlying layer of the sintered carbide pins obviates any need for the interposition of a bonding layer therebetween as for example would result from brazing or soldering. By providing a massive, stiff, non-yielding support in the form of a pin in direct contact with the polycrystalline diamond layer, the incidence of fracturing and chipping of the diamond material is greatly minimized.

Figure 4B:
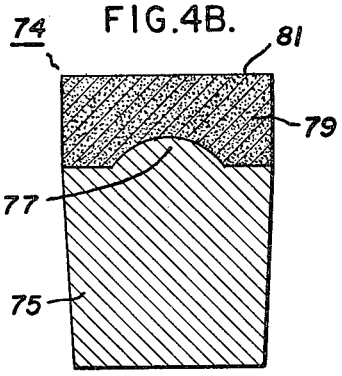
FIGS. 4B through 4G are cross-sectional views of alternative cutting elements for use in the rock drill bit of FIG. 3.
Figure 4C:
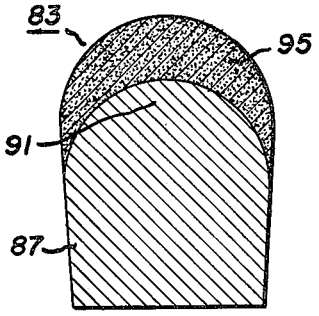

As will be recognized by those skilled in the art, there are other cutting element designs in accordance with the features of this invention. FIGS. 4B through 4C represent some of the design alternatives which may be used in accordance with the invention herein. The cutting elements illustrated in these Figures are made in accordance with the description set forth hereinabove with respect to cutting element 59. As will be appreciated, the practice of the process for making the elements with preformed cemented carbide pins will greatly simplify the process for making the cutting elements in view of the complex design of the end of the pin which interfaces with the bonded diamond layer.

FIG. 4B shows a design variation comprising a tapered cylindrical carbide pin 75 with reduced diameter hemispherical projection 77 which interfaces with a bonded diamond layer 79. The outer surface 81 of the layer 79 has a right cylindrical outer surface which gives the cutting element 74 cutting capability in addition to a spalling action noted above for element 59. However, element 74 would be subject to greater cracking and breakage of the diamond layer 79 than would be the cutting element 59 of FIG. 4A.

Figure 4D:
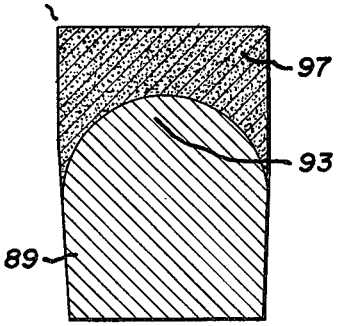

FIGS. 4C and 4D show cutting elememt designs similar to that of FIGS. 4A and 4B, respectively except that one end of carbide pins 87 and 89 have a hemispherical end portions 91 and 93, respectively equal in diameter to that of the pin body interfacing with hemispherical and right cylindrical diamond layers 95 and 97.

Figure 4E:
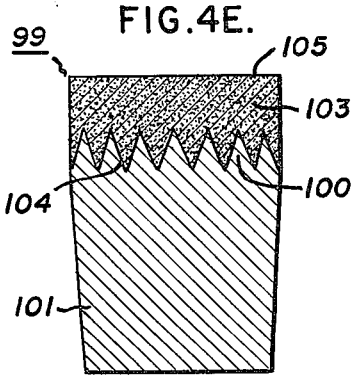

FIG. 4E shows a cutting element 99 which is comprised of a carbide pin 101 terminating at one end 100 in a substantially planar serrated edge and a diamond layer 103 bonded therto. The outer surface 105 of diamond layer 103 has a right cylindrical shape, and as in the case of FIG. 4B, provides superior cutting properties. The serrated edge is formed by cutting a plurality of grooves 104, in any arrangement, in the end of a preformed pin prior to bonding the diamond layer thereon. This provides greater resistance to delamination of the diamond layer 105 from the pin end 100. The depth of the grooves is preferably between 10 and 1000 microns.

Figure 4F:
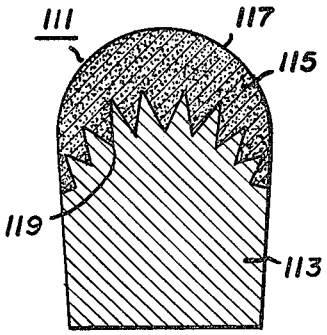

FIG. 4F shows another variation of a cutting element 111, which is comprised of a pin 113 and a diamond layer 115 with a hemispherical outer surface 117. Pin 113 has a serrated hemispherically shaped end 119 equal in diameter to that of the pin 113. As in the case of FIG. 4E, the serrated edge provides enhanced resistance to delamination of diamond layer 115.

Figure 4G:
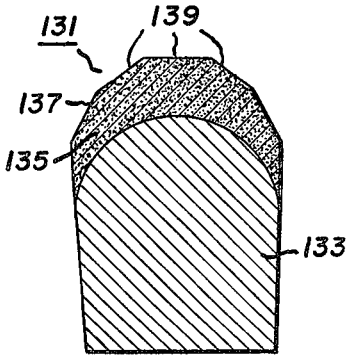

In FIG. 4G, which illustrates still another variation, a cutting element 131 is shown which comprises a tapered pin 113 and diamond layer 135. The outer surface 137 of layer is generally hemispherical with a series of flats 139 formed therein. The flats 139 tends to provide an improved cutting action due to the plurality edges which are formed on surface 137 by the contiguous sides of the flats 139.

While the invention has been illustrated and described in connection with certain preferred embodiments thereof, it will be apparent to those skilled in the art that the invention is not limited thereto. Accordingly, it is intended that the appended claims cover all modifications which are within the true spirit and scope of the invention.

I claim:

1. A drill bit comprising:
(a) a shaft;
(b) a crown fixed to one end of said shaft having a plurality of inwardly tapered recesses formed therein; and
(c) a plurality of cutting element, each element comprising
(1) a tapered, integral pin having a smaller one of the two ends disposed in one of said recesses, and the tapers of said pin and said one recess sized such that said pin is in a state of radial compression and is retained in said one recess by a self-locking friction-fit, and
(2) a thin polycrystalline layer of self-bonded diamond crystals directly bonded to the other end of said pin at an interface consisting of the material of said pin and said crystals.

2. The bit of claim 1 wherein said pin and recesses are tapered between 2 and 4°.

3. The bit of claim 1 wherein the outer surface of said layer is a right cylinder.

4. The bit of claim 1 wherein said pin is cemented carbide.

5. The bit of claim 1 wherein said pin is radially compressed under a stress in the range of approximately 3,500 to 21,000 kg/cm$^2$.

6. The bit of claim 1 wherein said layer is bonded to said pin by intrusions of the pin material into the abrasive layer.

7. A drill bit comprising:
(a) a shaft;
(b) a crown fixed to one end of said shaft, said crown having a plurality of recesses formed therein; and
(c) a plurality of cutting elements, each element comprising
(1) an integral pin having one end tightly held in one of said recesses; and
(2) a thin polycrystalline layer of abrasive crystals directly bonded to the other end of said pin at an interface, said interface consisting of the material of said pin and the abrasive crystals and, said layer having a hemispherical outer surface.

8. The bit of claim 7 wherein said other end of said pin has a reduced diameter hemispherical projection.

9. The bit of claim 7 wherein said recess and pin are tapered approximately between 2° and 4°, said recess is inwardly tapered for receiving said one and smaller end of the pin.

10. The bit of claim 7 wherein said pin is in a state of radial compression in the range of approximately 3,500 to 21,000 kg/cm$^2$ and is retained in said one recess by a self-locking friction-fit.

11. The bit of claim 7 wherein said layer is bonded to said pin by intrusion of the pin material into said layer.

12. A drill bit comprising:
(a) a shaft;
(b) a crown fixed to one end of said shaft having a plurality of inwardly tapered recesses formed therein; and
(c) a plurality of cutting elements, each element comprising
(1) a tapered pin having the smaller one of the two ends disposed in one of said recesses, and the tapers of said pin and said one recess sized such that said pin is in a state of radial compression and is retained in said one recess by a self-locking friction-fit, and
(2) a thin layer of polycrystalline abrasive crystals bonded to the other end of said pin, said layer having a hemispherical outer surface.

13. The bit of claim 12 wherein said pin and recesses are tapered between 2° and 4°.

14. The bit of claim 12 wherein said other end of said pin has a reduced diameter hemispherical projection.

15. The bit of claim 12 wherein said other end of said pin is serrated.

16. The bit of claim 12 wherein said crystals are diamond and said pin is cemented carbide.

17. The bit of claim 12 wherein said pin is radially compressed under a stress in the range of approximately 3,500 to 21,000 kg/cm$^2$.

18. The bit of claim 12 wherein said abrasive layer is bonded to said pin by intrusion of the pin material into the abrasive layer.

19. The bit of claim 12 wherein said pin is an integral structure.

20. The bit of claim 19 wherein said abrasive layer is directly bonded to said pin at an interface consisting of the material of said pin and said abrasive crystals.

21. A drill bit comprising:
(a) a shaft;
(b) a crown fixed to one end of said shaft having a plurality of inwardly tapered recesses formed therein; and
(c) a plurality of cutting elements, each element comprising
(1) a tapered pin, the smaller one of the two ends of said pin disposed in one of said recesses, the tapers of said pin and said one recess sized such that said pin is in a state of radial compression and is retained in said recess by a self-locking friction-fit, and the other end of said pin having a reduced diameter hemispherical projection, and
(2) a thin polycrystalline layer of abrasive crystals bonded to the other end of said pin, said layer having a right cylindrical outer surface.

22. The bit of claim 21 wherein said pin and recesses are tapered between 2° and 4°.

23. The bit of claim 21 wherein said crystals are diamond and said pin is cemented carbide.

24. The bit of claim 21 wherein said pin is radially compressed under a stress in the range of approximately 3,500 to 21,000 kg/cm$^2$.

25. The bit of claim 21 wherein said abrasive layer is bonded to said pin by intrusion of the pin material into the abrasive layer.

26. The bit of claim 21 wherein said pin is an integral structure.

27. The bit of claim 26 wherein said abrasive layer is directly bonded to said pin at an interface consisting of the material of said pin and said abrasive crystals.

28. A drill bit comprising:
(a) a shaft;
(b) a crown fixed to one end of said shaft having a plurality of inwardly tapered recesses formed therein; and
(c) a plurality of cutting elements, each element comprising
(1) a tapered pin having the smaller one of the two ends disposed in one of said recesses, and the tapers of said pin and said one recess sized such that said pin is in a state of radial compression and is retained in said one recess by a self-locking friction-fit, the other end of said pin having a reduced diameter hemispherical projection; and
(2) a thin layer of polycrystalline abrasive crystals bonded to said other end of said pin.

29. The bit of claim 28 wherein said pin and recesses are tapered between 2° and 4°.

30. The bit of claim 28 wherein the outer surface of said layer is hemispherical.

31. The bit of claim 28 wherein the outer surface of said layer is a right cylinder.

32. The bit of claim 28 wherein said crystals are diamond and said pin is cemented carbide.

33. The bit of claim 28 wherein said pin is radially compressed under a stress in the range of approximately 3,500 to 21,000 kg/cm$^2$.

34. The bit of claim 28 wherein said abrasive layer is bonded to said pin by intrusion of the pin material into the abrasive layer.

35. The bit of claim 28 wherein said pin is an integral structure.

36. The bit of claim 35 wherein said abrasive layer is directly bonded to said pin at an interface consisting of the material of said pin and said abrasive crystals.

37. A drill bit comprising:
(a) a shaft;
(b) a crown fixed to one end of said shaft having a plurality of inwardly tapered recesses formed therein; and
(c) a plurality of cutting elements, each element comprising
(1) a tapered pin having the smaller one of the two ends disposed in one of said recesses, and the tapers of said pin and said one recess sized such that said pin is in a state of radial compression and is retained in said one recess by a self-locking friction-fit, said other end of said pin being serrated; and
(2) a thin layer of polycrystalline abrasive crystals bonded to said other end of said pin.

38. The bit of claim 37 wherein said pin and recesses are tapered between 2° and 4°.

39. The bit of claim 37 wherein the outer surface of said layer is hemispherical.

40. The bit of claim 37 wherein said crystals are diamond and said pin is cemented carbide.

41. The bit of claim 37 wherein said pin is radially compressed under a stress in the range of approximately 3,500 to 21,000 kg/cm$^2$.

42. The bit of claim 37 wherein said abrasive layer is bonded to said pin by instrusion of the pin material into the abrasive layer.

43. The bit of claim 37 wherein said pin is an integral structure.

44. The bit of claim 43 wherein said abrasive layer is directly bonded to said pin at an interface consisting of the material of said pin and said abrasive crystals.

45. The bit of claim 44 wherein said crystals are diamond and said pin is cemented carbide.

46. A drill bit comprising:
(a) a shaft;
(b) a crown fixed to one end of said shaft, said crown having a plurality of recesses formed therein; and
(c) a plurality of cutting elements, each element comprising
(1) an integral, cemented carbide pin having one end tightly held in one of said recesses; and
(2) a thin polycrystalline layer of diamond directly bonded to the other end of said pin at an interface, said interface consisting of the material of said pin and the layer, said layer having a hemispherical outer surface.

47. The bit of claim 46 wherein the outer surface of said layer is a right cylinder.

48. The bit of claim 46 wherein said recess and pin are tapered approximately between 2° and 4°, said recess is inwardly tapered for receiving said one and smaller end of the pin.

49. The bit of claim 46 wherein said pin is in a state of radial compression in the range of approximately 3,500 to 21,000 kg/cm$^2$ and is retained in said one recess by a self-locking friction-fit.

50. The bit of claim 46 wherein said diamond layer is bonded to said pin by instrusion of the pin material into said layer.

51. A drill bit comprising:
(a) a shaft;
(b) a crown fixed to one end of said shaft having a plurality of inwardly tapered recesses formed therein; and
(c) a plurality of cutting elements, each element comprising (1) a tapered pin having the smaller one of the two ends disposed in one of said recesses, and the tapers of said pin and said one recess sized such that said pin is in a state of radial compression and is retained in said one recess by a self-locking friction-fit; and (2) a thin polycrystalline layer of self-bonded diamond crystals bonded to the other end of said pin, said layer having a hemispherical outer surface.

52. A drill bit comprising:

(a) a shaft;

(b) a crown fixed to one end of said shaft having a plurality of inwardly tapered recesses formed therein; and (c) a plurality of cutting elements, each element comprising (1) a tapered pin, the smaller one of the two ends of said pin disposed in one of said recesses, the tapers of said pin and said one recess sized such that said pin is in a state of radial compression and is retained in said one recess by a self-locking friction-fit, and the other end of said pin having a reduced diameter hemispherical projection, and (2) a thin polycrystalline layer of self-bonded diamond crystals bonded to said other end about said projection.

53. A drill bit comprising:

(a) a shaft;

(b) a crown fixed to one end of said shaft having a plurality of inwardly tapered recesses formed therein; and (c) a plurality of cutting elements, each element comprising (1) a tapered pin, the smaller one of the two ends of said pin disposed in one of said recesses, the tapers of said pin and said one recess sized such that said pin is in a state of radial compression and is retained in said one recess by a self-locking friction-fit, and the other end of said pin having serrations formed therein, and (2) a thin polycrystalline layer of self-bonded diamond crystals bonded to the other end of said pin.

54. A drill bit comprising:

(a) a shaft;

(b) a crown fixed to one end of said shaft, said crown having a plurality of recesses formed therein; and (c) a plurality of cutting elements, each element comprising (1) an integral pin, one end tightly held in one of said recesses, and the other end having a reduced diameter hemispherical projection; and (2) a thin polycrystalline layer of abrasive crystals directly bonded to the other end of said pin at an interface, said interface consisting of the material of said pin and the abrasive crystals.

55. A drill bit comprising:

(a) a shaft;

(b) a crown fixed to one end of said shaft having a plurality of inwardly tapered recesses formed therein; and (c) a plurality of cutting elements, each element comprising (1) a tapered pin, the smaller one of the two ends of said pin disposed in one of said recesses, the tapers of said pin and said one recess sized such that said pin is in a state of radial compression and is retained in said recess by a self-locking friction-fit, and the other end of said pin having serrations formed therein, and (2) a thin polycrystalline layer of abrasive crystals bonded to the other end of said pin, said layer having a right cylindrical outer surface.

56. A drill bit comprising:

(a) a shaft;

(b) a crown fixed to one end of said shaft, said crown having a plurality of recesses formed therein; and (c) a plurality of cutting elements, each element comprising (1) an integral, cemented carbide pin, one end thereof tightly held in one of said recesses, and the other end thereof having a reduced diameter hemispherical projection; and (2) a thin polycrystalline layer of diamond directly bonded to the other end of said pin at an interface, said interface consisting of the material of said pin and the layer.

* * * * *